US007321307B1

(12) United States Patent
Tow et al.

(10) Patent No.: US 7,321,307 B1
(45) Date of Patent: Jan. 22, 2008

(54) CHEMICAL TIME MODIFICATION OF AN OBJECT

(75) Inventors: Robert F. Tow, Los Gatos, CA (US); Randall B. Smith, Palo Alto, CA (US); Glenn Carter Scott, Mountain View, CA (US); Roger C. Meike, Emerald Hills, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 290 days.

(21) Appl. No.: 11/062,399

(22) Filed: Feb. 22, 2005

(51) Int. Cl.
*G08B 13/14* (2006.01)

(52) U.S. Cl. ..... 340/572.3; 340/309.16; 340/527; 340/572.1; 340/572.3; 116/206; 369/89

(58) Field of Classification Search ..... 340/572.3, 340/539.1, 568.7, 572.1, 505, 527, 309.16; 109/25; 368/89; 116/206
See application file for complete search history.

(56) References Cited

U.S. PATENT DOCUMENTS

| | | | | |
|---|---|---|---|---|
| 6,564,726 | B1 * | 5/2003 | Lindskog | 109/25 |
| 6,801,129 | B2 * | 10/2004 | Grimm | 340/568.7 |
| 7,121,215 | B2 * | 10/2006 | Besnard | 109/25 |
| 7,138,917 | B2 * | 11/2006 | Nishiwaki | 340/572.1 |
| 7,232,253 | B2 * | 6/2007 | Isbitsky et al. | 368/89 |

* cited by examiner

*Primary Examiner*—Davetta W. Goins
(74) *Attorney, Agent, or Firm*—Osha • Liang LLP

(57) ABSTRACT

A method for modifying an object involves determining a modification rate for the object, creating a first reservoir and a first wicking channel based on the modification rate, where the first reservoir and the first wicking channel are on the object and the first wicking channel is operatively connected to the first reservoir, and filling the first reservoir with a chemical for modifying the object, wherein an amount of chemical in the first reservoir is determined based on the modification rate.

24 Claims, 3 Drawing Sheets

CHEMICAL TIME MODIFICATION OF AN OBJECT

BACKGROUND

Typically, objects, such as electrical circuits, mechanical devices, or any other operable device, have an associated "lifetime." Objects may live indefinitely, or be manually and deliberately destroyed after some specified period of time. For example, objects may include an electrical timer within the object that allows the object to be disabled when the timer expires. The electrical timer may include functionality to set different times for destroying the object based on the circuitry of the timer. Further, objects may be destroyed by disabling a portion of the object, disabling the entire object, etc.

For an object to operate correctly, all the components of the object must be functional. For example, when a circuit is designed, all the components and connections between components need to operate correctly in order for the circuit as a whole to function. For example, consider the operation of a radio frequency identification (RFID) tag. An RFID tag includes a wireless transducer that may be linked to a single silicon chip, an antenna that can transmit data to a wireless receiver, and an encapsulating material. RFID systems include an RFID tag and a reader. Readers capture the information stored or gathered by the RFID tag. There are several types of RFID tags, including high frequency tags, intermediate frequency tags, low frequency tags, passive tags (i.e., externally powered), and active (i.e., battery powered) tags. Low frequency tags are used for application such as security access and asset management, which require shorter read ranges. High frequency systems are used for applications such as toll-collection and railroad car tracking, which require long distance read ranges. While high frequency RFID tags transmit data faster and can be read from farther away, they may also consume more power and are more expensive than low-frequency tags. Because RFID tags do not need a line of sight to read, they can be easily implemented to track a variety of products.

Regardless of the type of RFID tag, in order for the RFID tag to transmit data and be readable by an RFID reader, all the components (i.e., the antenna, the components on the silicon chip, etc.) must operate correctly. Conventionally, RFID tags "live forever" (i.e., the tag itself is readable for an indefinite period of time). RFID tags may be designed so that when a company or individual responsible for the RFID system or RFID tag wishes to disable the RFID tag, the RFID tag is "blown out" by an external energy field. Once the RFID tag is disabled in this manner, the RFID tag cannot be reactivated.

SUMMARY

In general, in one aspect the invention relates to a method for modifying an object. The method involves determining a modification rate for the object, creating a first reservoir and a first wicking channel based on the modification rate, wherein the first reservoir and the first wicking channel are on the object and the first wicking channel is operatively connected to the first reservoir, and filling the first reservoir with a chemical for modifying the object, wherein an amount of chemical in the first reservoir is determined based on the modification rate.

In general, in one aspect the invention relates to an apparatus for modifying an object. The apparatus includes a first reservoir comprising a chemical for modifying the object, wherein the chemical is at least one selected from the group consisting of a disabling chemical and an activating chemical; and a first wicking channel configured to provide a path for the chemical to flow to the object, wherein the first reservoir and the first wicking channel are on the object and the first wicking channel is operatively connected to the first reservoir, and wherein the first reservoir and the first wicking channel are created based on a modification rate of the object.

In general, in one aspect the invention relates to an apparatus for modifying an object. The apparatus includes a first sealed reservoir configured to store a first chemical, a first wicking channel configured to connect the first sealed reservoir to the object, wherein the first sealed reservoir and the first wicking channel are created based on a modification rate of the object, a second sealed reservoir configured to store a second chemical, and a second wicking channel configured to connect the second sealed reservoir to the object, wherein the second sealed reservoir and the second wicking channel are created based on a modification rate of the object, and wherein unsealing both the first reservoir and the second reservoir produces an aggregate modification rate of the object.

Other aspects of the invention will be apparent from the following description and the appended claims.

DETAILED DESCRIPTION

Figure 1:
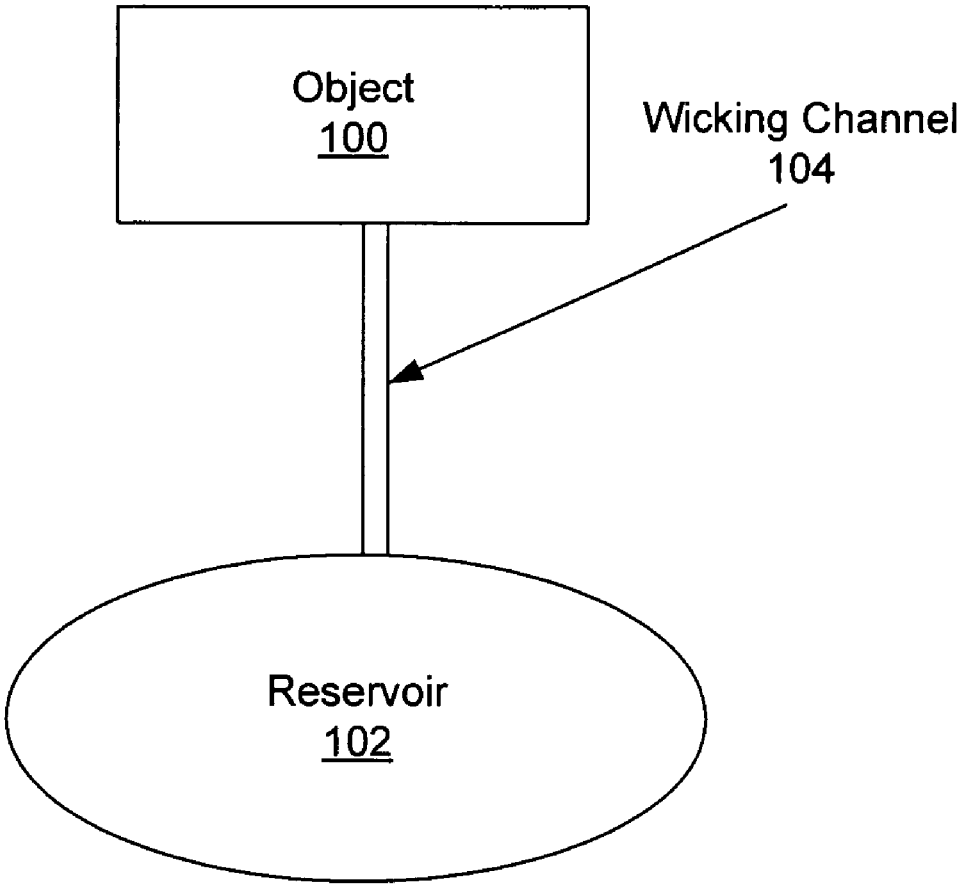
FIG. 1 shows an object in accordance with one embodiment of the invention.

Specific embodiments of the invention will now be described in detail with reference to the accompanying figures. Like elements in the various figures are denoted by like reference numerals for consistency. Further, the use of "ST" in the drawings is equivalent to the use of "Step" in the detailed description below.

In the following detailed description of embodiments of the invention, numerous specific details are set forth in order to provide a more thorough understanding of the invention. In other instances, well-known features have not been described in detail to avoid obscuring the invention.

In general, embodiments of the invention relate to a method and apparatus for controlled modification of objects. More specifically, embodiments of the invention relate to providing a method and system for allowing an object to operate (or remain dormant) for some definite period of time by virtue of its own agency for some elapsed span of time. Further, embodiments of the invention provide a timing circuit in the form of a chemical process to gradually disable (or enable) the operability of objects.

FIG. 1 shows an object (100) in accordance with one embodiment of the invention. Specifically, FIG. 1 includes a reservoir (102) for storing a chemical (not shown) to modify the object (100), and a wicking channel (104) that connects the reservoir (102) to a portion of the object. In one embodiment of the invention, the object (100) may be any functional component, such as an electrical circuit, a mechanical device, a micromachine, etc.

In one embodiment of the invention, the reservoir (102) is a depressed area in relatively close proximity of the object (100) and is responsible for storing the chemical. In one embodiment of the invention, the reservoir (102) may be etched on the surface of the object (100). Further, upon creation, the reservoir may be sealed so that the chemical does not immediately leak from the reservoir. The reservoir may be sealed using any sealable means, such as a fusible link, plastic material, etc. In one embodiment of the invention, the dimensions of the reservoir (102) (i.e., volume, area, etc.) may be determined based on a desired modification rate for the object (100) (discussed below). Further, in one embodiment of the invention, the chemical used to modify a portion of the object may be any wickable liquid capable of disabling (or enabling) a portion of the object, for example, an acid. Specifically, the chemical used may disable (or enable) a portion of the object by attacking (or depositing) the material of the object, e.g., metal or copper portions of the object.

Continuing with FIG. 1, the wicking channel (104) may also be etched on the object (100), where the wicking channel (104) connects the reservoir (102) to the portion of the object which decays upon contact with the chemical. More specifically, the wicking channel (104) provides a path for the chemical to flow from the reservoir (102) to the object. In FIG. 1, the wicking channel is shown connecting the reservoir (102) directly to the object (100). Alternatively, the wicking channel (104) may connect the reservoir (102) to any portion of the object capable of being disabled (or enabled) by contact with the chemical in the reservoir (102). In one embodiment of the invention, the chemical may be passed along the channel using a pressured substance (i.e., a blister packet leading along the channel) where the reservoir is under initial pressure.

In one embodiment of the invention, the object shown in FIG. 1 may be an RFID tag. As described above, an RFID tag is a small object, such as an adhesive sticker, that can be attached to or incorporated into a product and is capable of receiving and responding to radio frequency queries from an RFID reader. In this example, RFID circuitry includes a spiral antenna used to transmit data to the RFID reader and a resonant circuit. Further, RFID circuitry may include other circuit components such as a switch, a sensor, etc.

Continuing with the RFID tag example, a reservoir and wicking channel may be created on the surface of the RFID tag, where sufficient extra space exists due to the large area needed for the antenna. Those skilled in the art will appreciate that the reservoir may also overlay other components of the RFID tag. In one embodiment of the invention, the wicking channel may connect the reservoir to the antenna of the RFID tag. Thus, when a disabling chemical flows via the wicking channel to the RFID tag, the chemical may corrode the metallic composition of the antenna so that the RFID tag is not longer able to radiate or transmit signals. Alternatively, in one embodiment of the invention, the wicking channel may connect the reservoir to the resonant circuit or a portion of the resonant circuit of the RFID tag, thereby rendering the RFID tag inoperable by disabling other portions of the RFID tag.

Those skilled in the art will appreciate that the chemical may be a disabling chemical that corrodes, destroys, or simply disables the portion of the object that comes into contact with the chemical. Those skilled in the art will also appreciate that although FIG. 1 shows one reservoir and a single wicking channel connecting the reservoir to the objects, embodiments of the invention may include the creation of several reservoirs and associated wicking channels which lead to either the same portion of the object or different portions of the object. In this case, each of the multiple reservoirs may store a different chemical. Further, those skilled in the art will appreciate that any object may be chemically modified using the method of the present invention, such as, an integrated circuit, microelectromechanical systems (MEMS), a landmine, a micromachine array, etc.

In one embodiment of the invention, a reservoir and corresponding wicking channel etched onto an object may also be used with a chemical to activate the object. More specifically, consider the scenario in which an object that provides a particular functionality is to remain dormant until a specified period of time. In this case, a reservoir and wicking channel (or multiple reservoirs and associated wicking channels) may be created to allow an activating chemical to flow to a portion of the object, where the activating chemical is used to activate a component(s) of the object, thereby allowing the object to operate after the component(s) are activated. For example, a reservoir that stores water containing silver deposits may be created. In this scenario, when the water containing silver deposits is allowed to flow via a wicking channel to an electrical circuit, the silver deposits may allow (e.g., antenna) current flow through the electrical circuit, thus providing a method for the electrical circuit to begin operating for a period matching the lifespan of the activating chemical.

Figure 2:
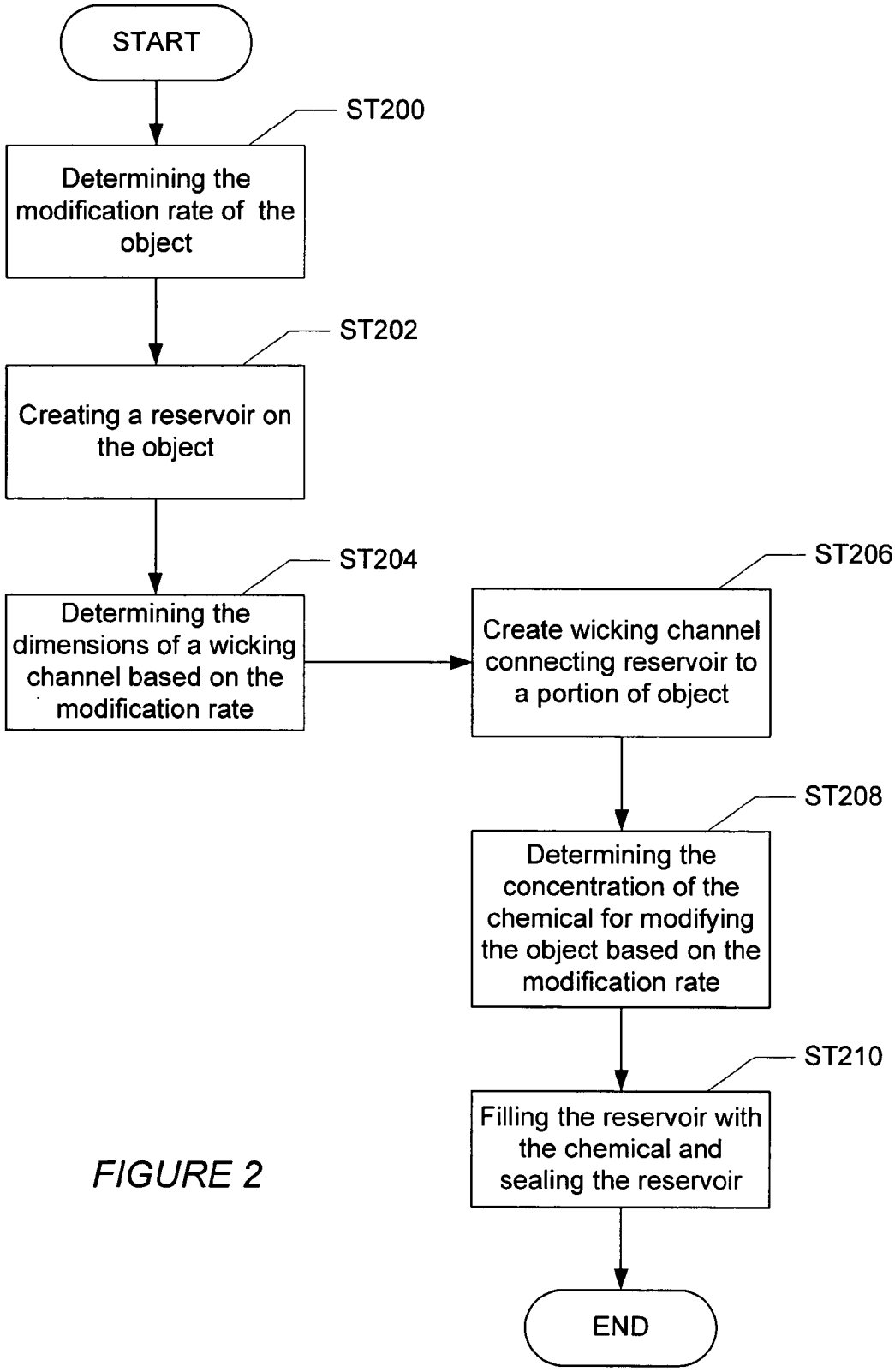
FIG. 2 shows a flow chart for modifying an object in accordance with one embodiment of the invention.

FIG. 2 shows a flow chart for modifying an object in accordance with one embodiment of the invention. Initially, a modification rate for the object is determined (Step 200). In one embodiment of the invention, the modification rate when using a disabling chemical may be an approximate time period in which the object is to cease functioning. More specifically, the modification rate when using a disabling chemical is the time period beginning with the start of a modifying process and ending when the object is no longer operational. In one embodiment of the invention, the modification rate when using an activating chemical may be an approximate time period in which the object remains dormant. More specifically, the modification rate when using an activating chemical is the time period beginning with the start of a modifying process and ending when the object is no longer dormant.

Subsequently, a reservoir is created on the object (Step 202). In one embodiment of the invention, the volume of the reservoir (i.e., the amount of chemical that the reservoir can hold) may be determined by the rate of modification. At this stage, dimensions of a wicking channel are determined based on the rate of modification of the object (Step 204). Subsequently, a wicking channel is created (Step 206), where the wicking channel is configured to connect the reservoir to some portion of the object. In one embodiment of the invention, the portion of the object may be a disabling portion that may be disabled by the disabling chemical such that the object as a whole is no longer operational. In one embodiment of the invention, the portion of the object may be an enabling portion that may be enabled by the activating chemical such that the object as a whole is no longer dormant.

Upon creation of both the reservoir and the wicking channel, the concentration of the chemical for modifying the object is determined (Step 208). In one embodiment of the invention, the concentration of the chemical may be determined by the modification rate. For example, considering the RFID tag example described above, if the chemical is to decay the antenna, and the modification rate desired is significantly fast, then the concentration of the chemical in the reservoir may be high. Once the concentration of the chemical is determined, the reservoir is filled with the chemical for modifying the object (Step 210). Subsequently, the reservoir may be sealed so that the chemical is permitted to flow to the appropriate portion of the object via the wicking channel upon unsealing of the reservoir at a later time (Step 210). In one embodiment of the invention, reservoirs may be sealed using a plug, a fusible link, a "blister pack" of a material that tears or breaks (e.g., plastic) when compressed, a material that melts when heated, etc.

The reservoir (or reservoirs) may be unsealed using one of several mechanisms. For example, in one embodiment of the invention, an electromagnetic field may be applied to blow a fusible link to open one or more reservoirs. Particularly, reservoirs may be sealed with a fusible link that blows open when exposed to an electromagnetic field. Further, the frequency at which the fusible links blow open may be varied such that applying an electromagnetic field of different frequencies blows the fusible links associated with different reservoirs. In one embodiment of the invention, a tunable resonant circuit may be placed near the sealed reservoir, and when a particular frequency of an electromagnetic field is applied (e.g., 800 MHz), a fusible link may blow and open the sealed reservoir. In the same manner, applying an electromagnetic field of multiple frequencies may blow the fusible link associated with more than one reservoir, so that a greater amount of chemical is released, effectively varying the time of modification based on how many reservoirs are unsealed. In one embodiment of the invention, the reservoir may be mechanically unsealed by manually pulling a tab attached to the object, causing the seal of one or more reservoirs to break or tear open. Further, the object to be modified may be compressed by applying pressure, causing the seal of one or more reservoirs to break. In this case, the seal of the reservoir may be weak in one area so that applying pressure causes the seal to break in the weak area.

In addition, in one embodiment of the invention, unsealing the reservoir may occur automatically or manually. For example, considering the RFID tag example described above, the reservoir(s) of the RFID tag may be unsealed automatically when the RFID tag is applied by a machine to a container or surface. Alternatively, the act of pulling the RFID tag off a roll of tape manually or applying a separate roller may result in the mechanical pressure needed to unseal the reservoir. Moreover, the reservoir may be unsealed by the aforementioned methods at any arbitrary time, beginning the modification process at some desired time.

Those skilled in the art will appreciate that the method shown in FIG. 2 may be repeated to create several reservoirs with individual wicking channels connecting each of the reservoirs with an appropriate portion of the object. Further, those skilled in the art will appreciate that several variables exist that may be changed based on the desired modification rate of the object. For example, multiple wicking channels may lead to different portions of the object or the same portion of the object, depending on whether modifying the same portion of the object with chemical from several wicking channel results in a faster modification time. Additionally, the concentration of the chemical, the dimensions of the wicking channel, the number of wicking channels created, etc., may all contribute to the rate of modification of the object. For example, the dimensions of the wicking channel may determine how quickly the chemical flows to a particular portion of the object.

Further, those skilled in the art will appreciate that a reservoir and wicking channel may be created on the object without initially knowing modification rate. For example, if several reservoirs are created on the surface of the object, then unsealing different combinations of reservoirs may allow various modification rates depending on the dimensions of each wicking channel associated with each reservoir and the concentration of the chemical in each of the reservoirs (discussed below).

Figure 3:
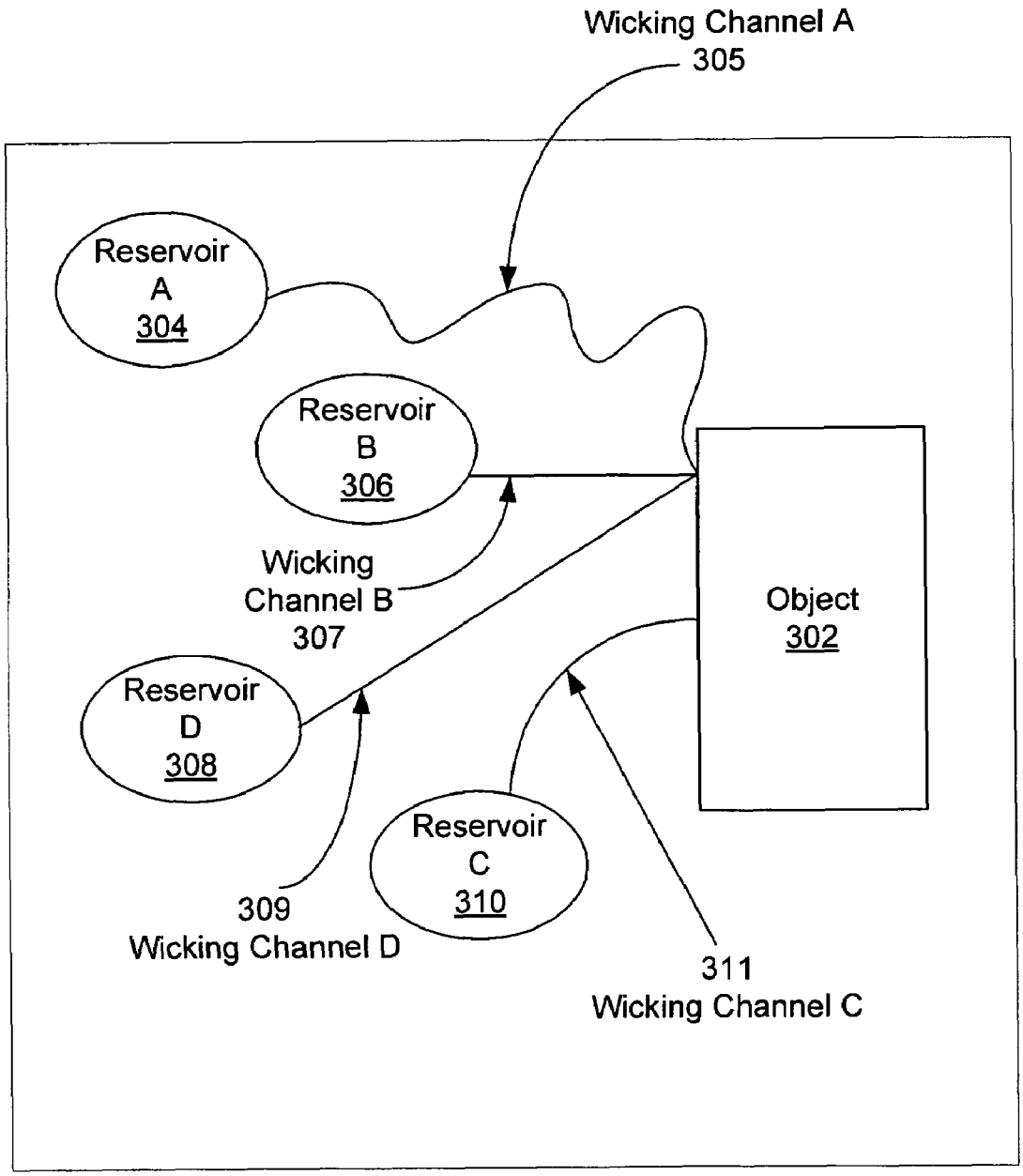
FIG. 3 show an example of chemically modifying an object in accordance with one embodiment of the invention.

Consider the scenario in which the multiple reservoirs and corresponding wicking channels each correspond to different time courses of modification, where unsealing one or more of the reservoirs allows "setting" differing time periods of modification. For example, a cascade of eight reservoirs with 2× modification times may serve as an either bit count down chemical timer that may be set for 255 different time spans for the modification of an object. FIG. 3 shows an example of chemically modifying an object using multiple reservoirs and corresponding wicking channels. Specifically, FIG. 3 shows an object (302) on a substrate (300) and several reservoirs (i.e., Reservoir A (304), Reservoir B (306), Reservoir C (310), Reservoir D (308)) and associated wicking channels (i.e., Wicking Channel A (305), Wicking Channel B (307), Wicking Channel C (310), Wicking Channel D (308)) on the substrate (300) that connect each reservoir to a portion of the object (302). In the example shown in FIG. 3, the reservoirs (Reservoir A, Reservoir B, Reservoir C, Reservoir D) and corresponding wicking channels (Wicking Channel A (305), Wicking Channel B (307), Wicking Channel C (311), Wicking Channel D (309)) each correspond to different rates of modification.

Particularly, the differing rates of modification are illustrated in FIG. 3 by the differences in each of the wicking channels (i.e., Wicking Channel A (305), Wicking Channel B (307), Wicking Channel C (310), Wicking Channel D (308)). As described above, several variables may be varied to produce differing rates of modification, and the dimensions of a wicking channel is one of these variables. In FIG. 3 for example, Wicking Channel A has a longer travel path than other wicking channels, whereas Wicking Channel B allows the chemical to travel faster to the object (302) due to the short distance of the wicking channel. Further, Wicking Channel A, Wicking Channel B, and Wicking Channel D all lead to the same portion of the object (302), where as Wicking Channel C (310) provides a path for the chemical to flow to a different portion of the object (302). In one embodiment of the invention, the aforementioned factors, along with the concentration of the chemical in each of the reservoirs, contribute to varying rates of modification.

In one embodiment of the invention, when more than one reservoir is unsealed, an aggregate rate of modification is achieved for modifying the object (302). Consider the example where both Reservoir A (304) and Reservoir B (306) are unsealed at the same time by blowing a tuned fusible link for both reservoirs. Suppose further than the modification rate associated with Reservoir A (304) is two days, and the modification rate associated with Reservoir B (306) is 1 day. When both Reservoir A (304) and Reservoir B (306) are unsealed, an aggregate rate of modification (i.e., the summation of the modification rates for both Reservoir A (304) and Reservoir B (306)) may be achieved so that the portion of the object is modified in less than one day. Those skilled in the art will appreciate that other combinations of sealed and unsealed reservoirs may result in different aggregate rates of modification.

Embodiments of the invention may be applied to modify a variety of mechanisms by interrupting, engaging, decaying, connecting, or destroying several types of objects. For example, an item sold at a store may be associated with an RFID tag that determines the period of time within which the item may be returned for a full refund. In this case, the RFID tag may be chemically modified to decay over a time period of two weeks or thirty days using the process described above. Once the RFID tag is no long operational, the item may not be returnable. Further, a tab may be pulled on an RFID tag applied to a camouflaged target designator on a battlefield, allowing the RFID tag to be detected and targeted for a defined period of time based on the modification rate determined for the RFID tag. Another example involves a micromachine array of antibodies that may be used for detection. In this case, the timed chemical modification process of the present invention may be used to attack and disable the micromachine array. Alternatively, a chemical that attaches to the antibodies may be used to destroy the antibodies on the micromachine array. Those skilled in the art will appreciate that applications of the present invention are not limited to the aforementioned examples and that any application that can use the gradual chemical modification of an object may be a suitable environment in which to use the present invention.

Further, embodiments of the invention may be used to modify a variety of mechanisms to activate, allow, enable, or engage several types of objects. For example, the activating chemical may be used to allow current flow in an electrical circuit. Alternatively, a tracking device may be enabled using an activating chemical such that the tracking device is enabled when the subject being tracked is a pre-determined distance away from an original location. In one embodiment of the invention, the tracking device may be disabled and undetectable until the activating chemical is released and allowed to enable the tracking device. Again, those skilled in the art will appreciate that applications of the present invention are not limited to the aforementioned examples and that any application that may benefit from the timely activation or enabling of an object may be suitable for embodiments of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for modifying an object, comprising:

determining a modification rate for the object;

creating a first reservoir and a first wicking channel based on the modification rate, wherein the first reservoir and the first wicking channel are on the object and the first wicking channel is operatively connected to the first reservoir; and filling the first reservoir with a chemical for modifying the object, wherein an amount of chemical in the first reservoir is determined based on the modification rate.

2. The method of claim 1, further comprising:

disabling the object using the chemical in the first wicking channel, wherein the chemical from the first reservoir is a disabling chemical and flows through the first wicking channel to a disabling portion of the object.

3. The method of claim 2, wherein the disabling chemical decays the disabling portion of the object.

4. The method of claim 3, wherein the disabling chemical is an acid.

5. The method of claim 2, wherein the object is a circuit comprising an antenna, wherein the disabling portion of the circuit is the antenna.

6. The method of claim 1, wherein creating the first wicking channel comprises determining at least one dimension of the wicking channel based on the modification rate.

7. The method of claim 1, wherein a concentration of the chemical is determined based on the modification rate.

8. The method of claim 2, further comprising:

creating a second reservoir and a second wicking channel based on the modification rate, wherein the second reservoir and the second wicking channel are on the object and the second wicking channel is operatively connected to the second reservoir.

9. The method of claim 8, wherein the first reservoir and the second reservoir are sealed.

10. The method of claim 9, further comprising:

unsealing at least one of the first reservoir and the second reservoir to allow decay of the disabling portion of the object.

11. The method of claim 9, further comprising:

unsealing both of the first reservoir and the second reservoir determines an aggregate rate of modification of the object.

12. The method of claim 1, further comprising:

enabling the object using the chemical in the first wicking channel, wherein the chemical from the first reservoir is an activating chemical and flows through the first wicking channel to an enabling portion of the object.

13. An apparatus for modifying an object, comprising:

a first reservoir comprising a chemical for modifying the object, wherein the chemical is at least one selected from the group consisting of a disabling chemical and an activating chemical; and a first wicking channel configured to provide a path for the chemical to flow to the object, wherein the first reservoir and the first wicking channel are on the object and the first wicking channel is operatively connected to the first reservoir, and wherein the first reservoir and the first wicking channel are created based on a modification rate of the object.

14. The apparatus of claim 13, wherein the object is disabled using the disabling chemical.

15. The apparatus of claim 13, wherein the object is enabled using the activating chemical.

16. The apparatus of claim 14, wherein the object is a circuit comprising an antenna, and wherein the antenna is a disabling portion.

17. The apparatus of claim 13, wherein the first reservoir is sealed and wherein unsealing the first reservoir allows the flow of the chemical along the wicking channel.

18. The apparatus of claim 17, further comprising:

a second reservoir comprising the chemical, wherein the second reservoir is sealed; and a second wicking channel configured to provide a path for the chemical to flow to the object, wherein the second reservoir and the second wicking channel are on the object and the second wicking channel is operatively connected to the second reservoir, and wherein the second reservoir and the second wicking channel are created based on a modification rate of the object.

19. The apparatus of claim 18, wherein at least one of the first reservoir and the second reservoir is unsealed based on the modification rate of the object.

20. The apparatus of claim 18, wherein the dimensions of the first wicking channel and the second wicking channel correspond to the modification rate of the object.

21. The apparatus of claim 18, wherein a concentration of the chemical in the first reservoir and the second reservoir is determined based on the modification rate of the object.

22. An apparatus for modifying an object, comprising:

a first sealed reservoir configured to store a first chemical;

a first wicking channel configured to connect the first sealed reservoir to the object, wherein the first sealed reservoir and the first wicking channel are created based on a modification rate of the object;

a second sealed reservoir configured to store a second chemical; and a second wicking channel configured to connect the second sealed reservoir to the object, wherein the second sealed reservoir and the second wicking channel are created based on a modification rate of the object, and wherein unsealing both the first reservoir and the second reservoir produces an aggregate modification rate of the object.

23. The apparatus of claim 22, wherein the first and the second chemical is an activating chemical to enable the object based on the aggregate modification rate.

24. The apparatus of claim 22, wherein the first and the second chemical is a disabling chemical to enable the object based on the aggregate modification rate.

* * * * *